US006006524A

United States Patent [19]

Park

[11] Patent Number: 6,006,524

[45] Date of Patent: Dec. 28, 1999

[54] TEMPERATURE CONTROLLER FOR BEDDING

[75] Inventor: Yong Jae Park, Seoul, Rep. of Korea

[73] Assignee: Ace Bed Co., Ltd., Chungcheongbug-Do, Rep. of Korea

[21] Appl. No.: 08/981,199

[22] PCT Filed: Apr. 18, 1997

[86] PCT No.: PCT/KR97/00060

§ 371 Date: Apr. 3, 1998

§ 102(e) Date: Apr. 3, 1998

[87] PCT Pub. No.: WO97/38607

PCT Pub. Date: Oct. 23, 1997

[30] Foreign Application Priority Data

Apr. 18, 1996 [KR] Rep. of Korea ..... 96-11775

[51] Int. Cl.[6] ..... F25B 21/02

[52] U.S. Cl. ..... 62/3.7; 62/3.2; 62/3.5

[58] Field of Search ..... 62/3.2, 3.3, 3.5, 62/3.7; 165/46

[56] References Cited

U.S. PATENT DOCUMENTS

| | | | |
|---|---|---|---|
| 3,111,008 | 11/1963 | Nelson | 62/3 |
| 4,459,468 | 7/1984 | Bailey | 219/297 |
| 5,097,829 | 3/1992 | Quisenberry | 128/400 |

FOREIGN PATENT DOCUMENTS

| | | |
|---|---|---|
| 52-22408 | 5/1977 | Japan . |
| 56-97416 | 8/1981 | Japan . |
| 58-25116 | 2/1983 | Japan . |
| 61-217112 | 7/1987 | Japan . |
| 3-186213 | 8/1991 | Japan . |
| 5-137632 | 6/1993 | Japan . |
| 6-209832 | 8/1994 | Japan . |
| 3022659 | 1/1996 | Japan . |

*Primary Examiner*—Henry Bennett
*Assistant Examiner*—Melvin Jones
*Attorney, Agent, or Firm*—Renner, Otto, Boisselle & Sklar, P.L.L.

[57] ABSTRACT

A temperature controller for bedding which can always provide a comfortable sleeping environment by maintaining bedding at a temperature suitable for the human body during sleeping by supplying cold or warm heat transfer medium to the inside of bedding, such as a floor mat or a bed mattress according to a preset temperature and a preset time. The temperature controller is constituted of a thermoelectric element 10 which selectively serves as a cooler or heater according to a set temperature, a controller 20 which compares the temperatures detected by means of a room temperature sensor 291, a supply temperature sensor 231 and a recovery temperature sensor 232 with set appropriate temperatures and operates the thermoelectric element 10 by outputting an output signal based on the set time of an operating time setting section 22, a heat exchanger 30 which causes heat exchange between heat exchange fins 11 cooled or heated by the thermoelectric element 10 and a heat transfer medium and supplies the heat transfer medium, and bedding 40 inside of which the heat transfer medium from the heat exchanger 30 is circulated.

13 Claims, 9 Drawing Sheets

TEMPERATURE CONTROLLER FOR BEDDING

FIELD OF THE INVENTION

The present invention relates to a temperature controller for bedding and, more particularly to a temperature controller for maintaining bedding equipment at a temperature preset for or by a person sleeping in it by controlling supply of the heated or cooled heat transfer medium at the preset temperature and for the set time for a comfortable sleeping environment into a bed mattress, a floor mat, or the like.

BACKGROUND OF THE INVENTION

Sleeping is a very important part of our life, occupying almost one third of human life. According to the sleeping environment, especially in the bed, we may have a sound sleep, invigorating us physically and mentally, or we can not sleep off our fatigue with disturbing the rhythm of not only the body itself but also our daily life.

Sleeping environment, among others, includes atmospheric temperature, humidity, etc. Ideal sleeping environment is secured where it is not affected by hot or cold weather. The inventor believes that the conditions such as the room temperature between 18 and 24° C., the bed temperature between 32 and to 34° C. and the humidity of about 50±5% are desirable.

Apart from these conditions, the time required to fall asleep differs from individuals and a sound sleep has nothing to do with the time taken. In other words, a sound sleep for a relatively short time can also refresh us in mind and body.

In order to secure a sound sleep, human beings have invented and used beds, Japanese floor mats(tatami), electric or non-electric quilts, etc. with or without applying magnetic, finger-pressure or far-infrared ray therapeutics.

Although the room temperature can be maintained at between 18 and 24° C., it is very hard to maintain the temperature in a bed of our home at the afore-said desirable level.

Electric quilts are used to keep beds or floor mat warm in the winter season, while electric fans or air conditioners are useful in the summer season. In this regard, it is feared that electromagnetic waves emitted from electric quilts may cause diseases such as cancer and electrical heat may have bad influences upon human bodies, i.e. drying and roughening the skin. Overheated appliances can be a direct cause of fire.

When an electric fan or air conditioner is kept operating during the time of sleeping, the user may suffer from evaporation of moisture from the body and drop of the body temperature and thus may be taken with an airconditioningitis or cold. When an electric fan or air conditioner is operated for a long time, it may cause oxygen deficiency in a narrow and closed room, claiming the life of the person sleeping in the room.

Accordingly, the present invention is directed to bedding systems with temperature control which may substantially obviate one or more of the problems due to limitations and disadvantages of the related art.

An object of the present invention is to provide bedding systems with temperature control for removing the problems with the electric quilts or the like by supplying the heat transfer medium heated or cooled to the preset temperature into the bedding equipment for the set time.

SUMMARY OF THE INVENTION

To achieve this and other objects of the present invention, as embodied and described, a temperature controller for bedding comprises: a thermoelectric element serving both as a cooler and a heater; a controller with a room temperature sensor, a supply temperature sensor and a recovery temperature sensor, which compares temperatures detected by those sensors with the preset appropriate temperature and operates the thermoelectric element by outputting an output signal based on the set time of an operating time setting section; a heat exchanger which causes heat exchange between a heat transfer medium and the thermoelectric element and supplies the heat transfer medium; and a bedding equipment provided with a heat transfer medium circulation path through which the heat transfer medium flows for returning to the heat exchanger.

For operating the temperature controller for bedding according to the present invention, an appropriate temperature and the operation time is preset. Then, the heat exchanger cools or heats the heat transfer medium surrounding it to a preset temperature. The heated or cooled heat transfer medium is supplied into the circulation path to maintain the bedding equipment at the preset appropriate temperature.

BRIEF DESCRIPTION OF THE ACCOMPANYING DRAWINGS

Figure 3A:
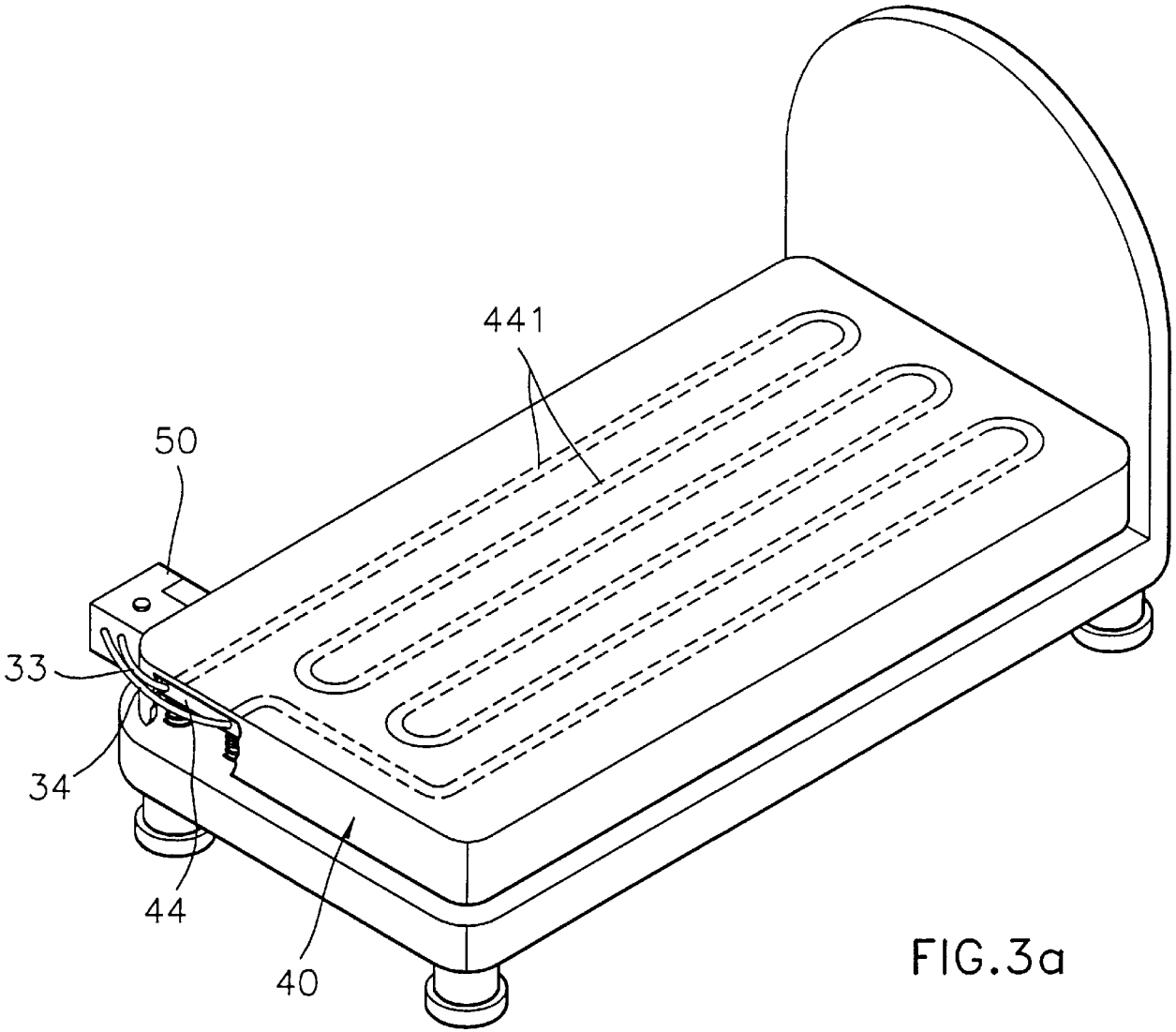
Figure 3B:
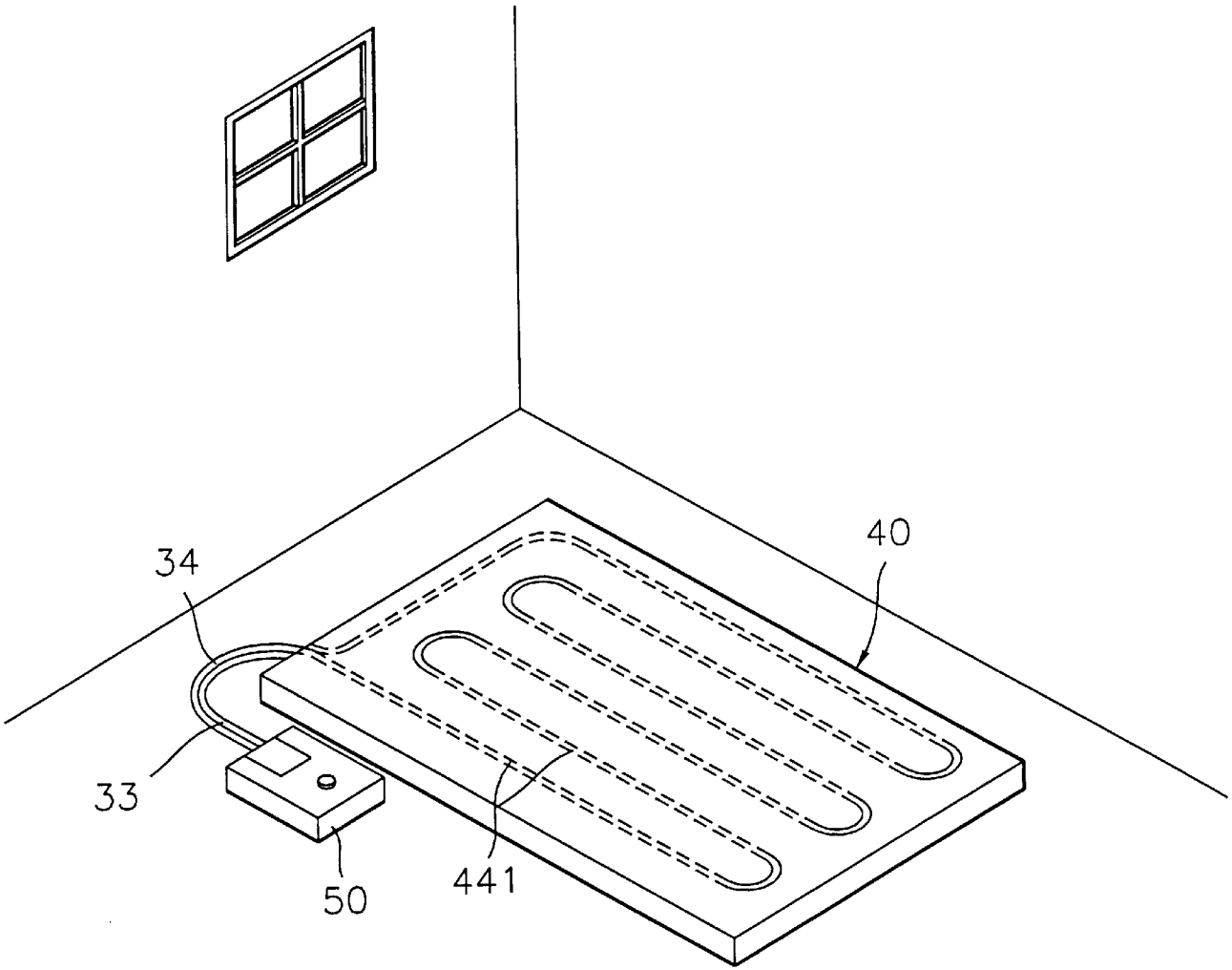
Figure 4:
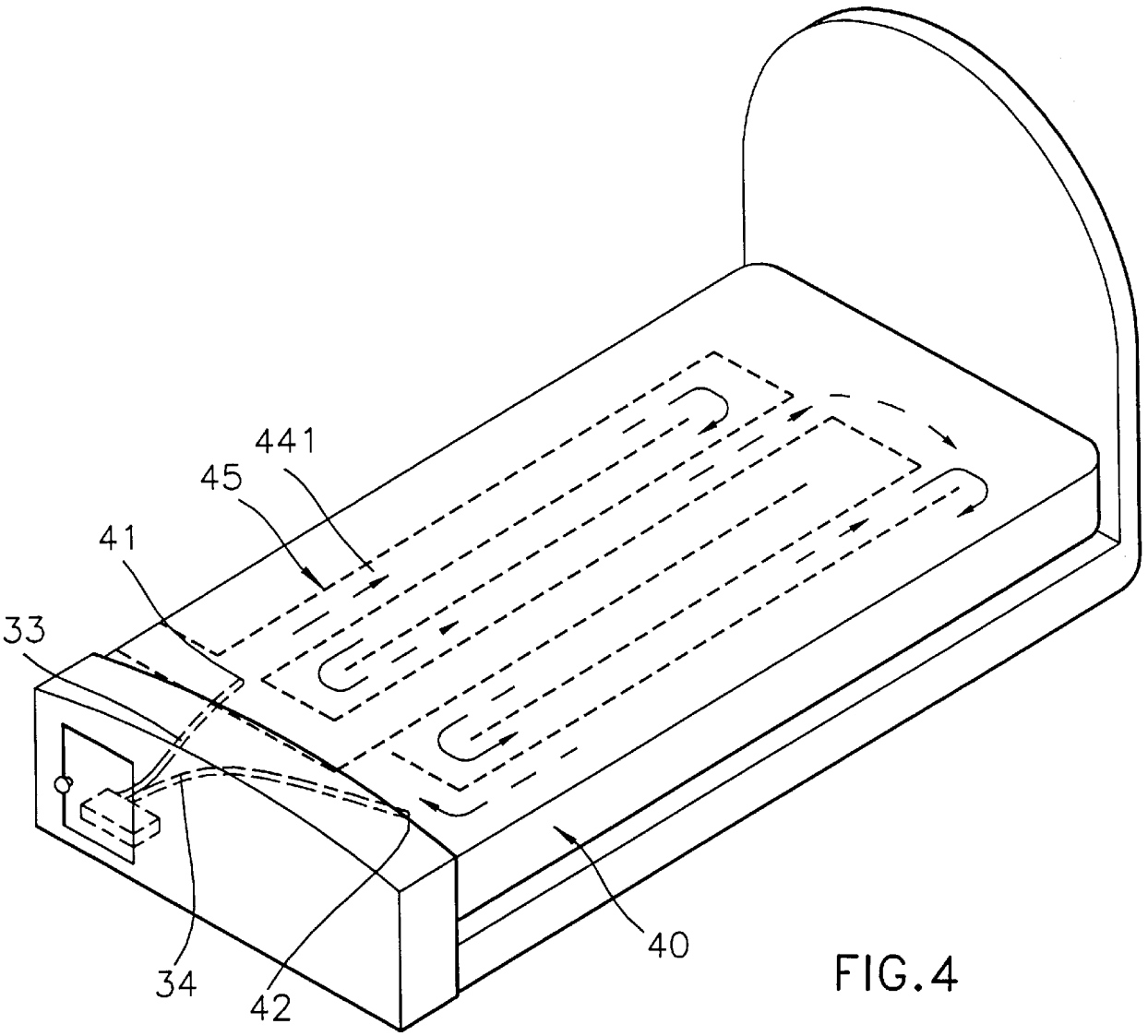
Figure 5:
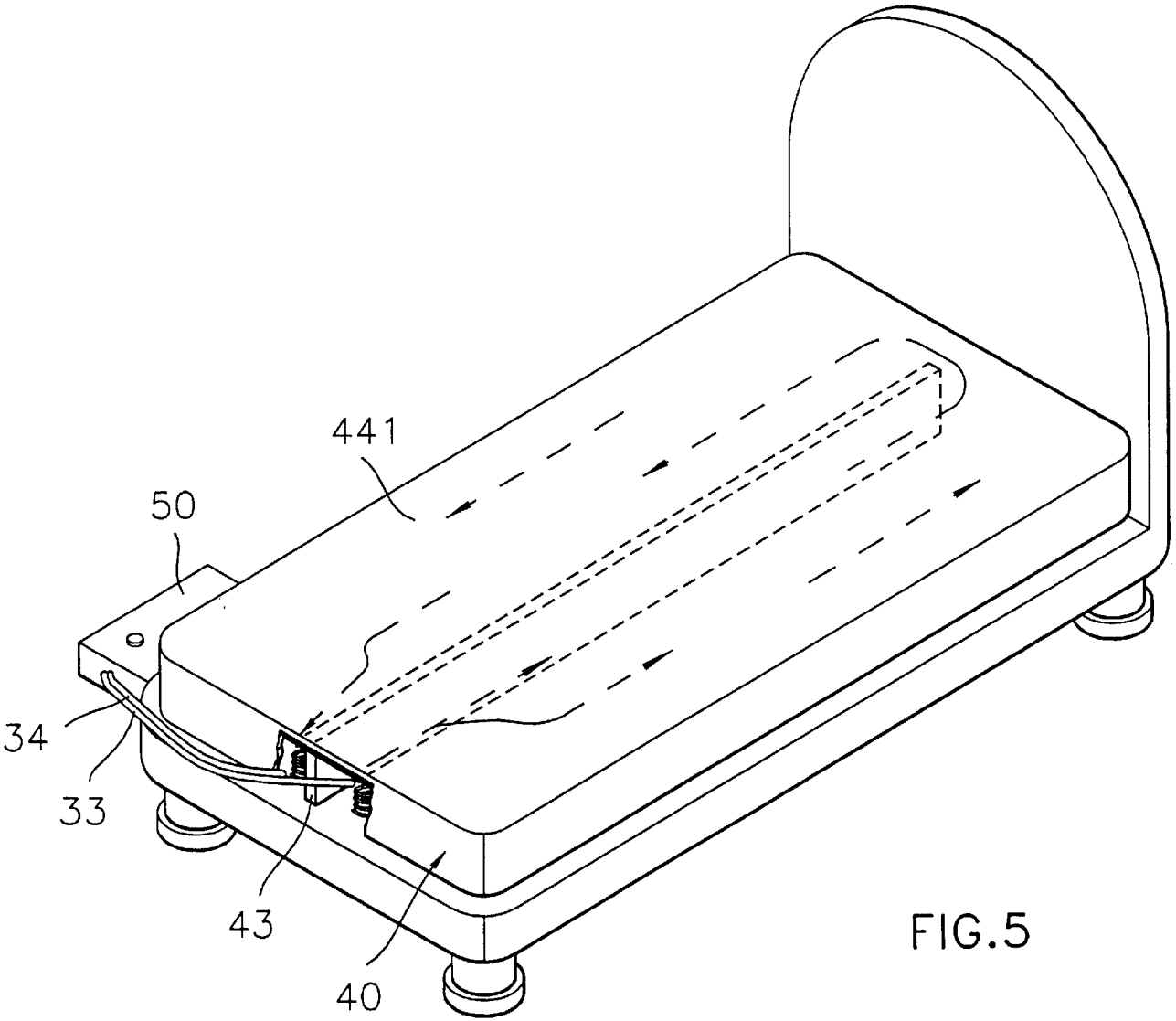
Figure 6A:
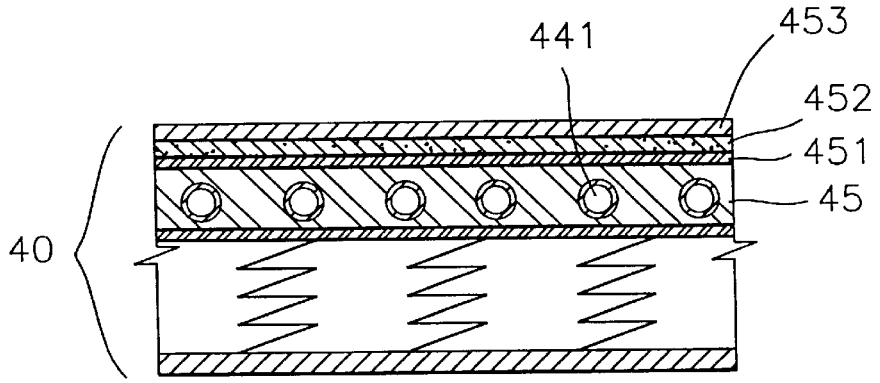

FIG. 3*a* is a perspective view of a bed to which first embodiment of the invention is applied;

FIG. 3*b* is a perspective view of a floor mat to which first embodiment of the invention is used;

FIG. 4 is a perspective view similar to that of FIG. 3*a*, showing an alternate bed mattress;

FIG. 5 is a perspective view similar to that of FIG. 3*a* with a different heat transfer medium flow;

FIG. 6*a* is a detail section of a portion in FIG. 3*a;*

Figure 6B:
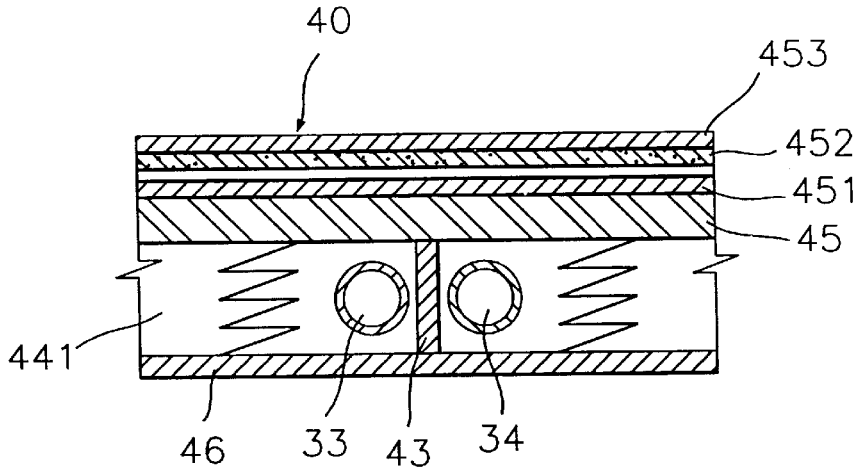
Figure 6C:
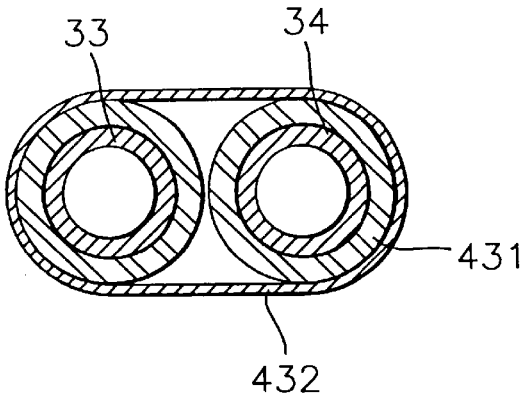
Figure 7:
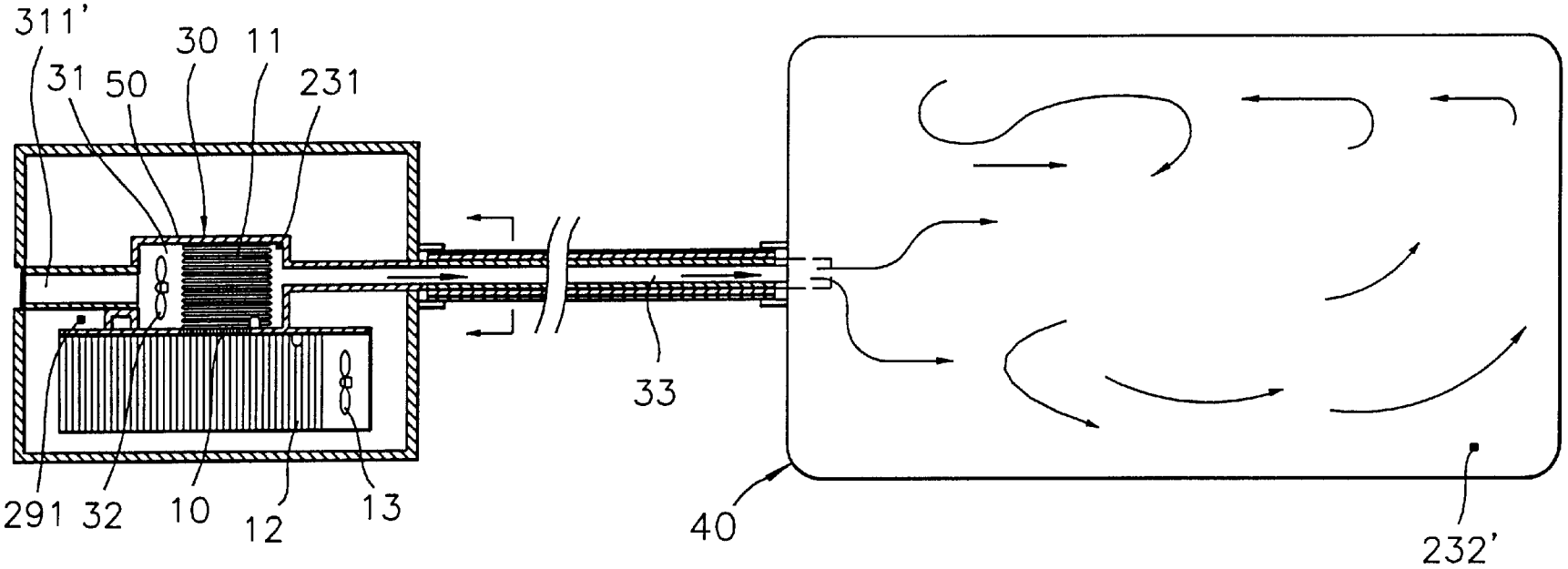
Figure 8:
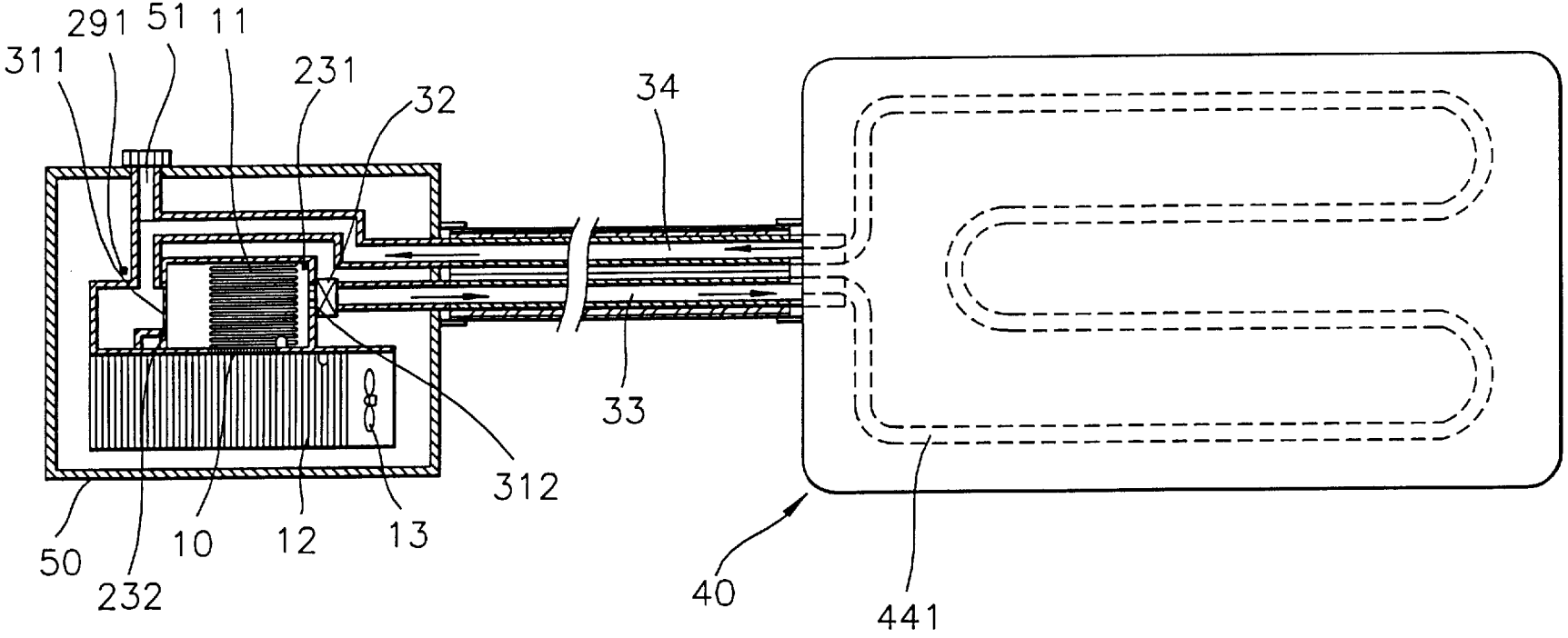

FIG. 6*b* is a detail section of a portion in FIG. 5;

FIG. 6*c* is an enlarged cross-sectional view illustrating a heat transfer medium tubing in accordance with first embodiment of the present invention;

FIG. 7 is a partially cut away schematic drawing of second preferred embodiment of the present invention; and FIG. 8 is a partially cut away schematic drawing of third preferred embodiment of the present invention.

Explanation of reference numerals;

10: thermoelectric element

20: controller

21: bedding temperature setting section

22: operation time setting section

231: supply temperature sensor

232: recovery temperature sensor

291: room temperature sensor

30: heat exchanger

40: bedding equipment

DETAILED DESCRIPTION OF PREFERRED EMBODIMENTS

Reference will now be made in detail to the preferred embodiments of the present invention, examples of which are illustrated in the accompanying drawings.

Figure 1:
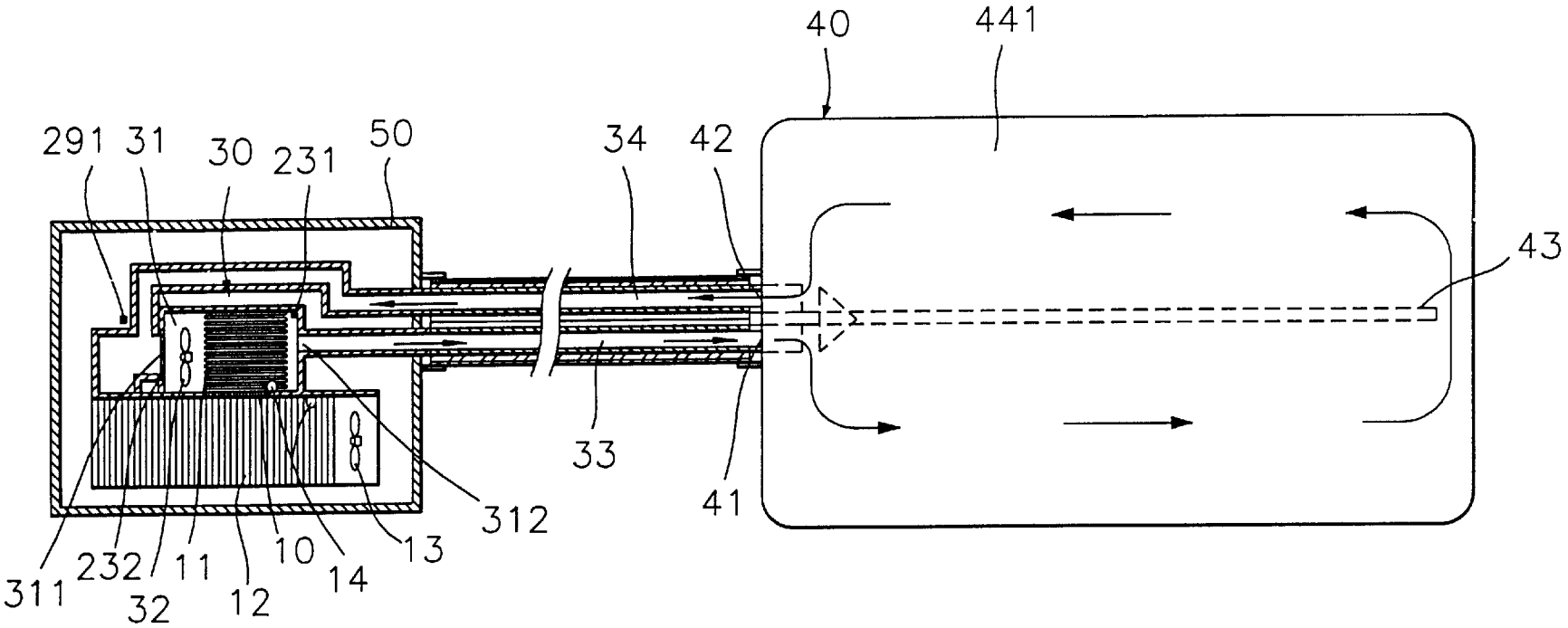
FIG. 1 is a partially cut away schematic drawing of a temperature controller for bedding in accordance with first preferred embodiment of the present invention.

FIG. 1 is a partially cut away schematic drawing of a temperature controller for bedding in accordance with first preferred embodiment of the present invention. Referring to FIG. 1, the temperature controller comprises a thermoelectric element 10 which selectively serves as a cooler or heater; a controller 20 (FIG. 2) which compares the temperatures detected by means of a room temperature sensor, a supply temperature sensor and a recovery temperature sensor with set appropriate temperatures and operates the thermoelectric element by outputting an output signal based on the set time of an operating time setting section; a heat exchanger 30 heated or cooled by the thermoelectric element 10 which causes heat exchange to a heat transfer medium; and a bedding equipment to which heated or cooled heat transfer medium is supplied for circulation.

The thermoelectric element 10 is desirably soundproof and installed in a controller case or a housing 50 in touch with the heat exchanger 30 which has tens of heat exchanging fins 11 and 12 on and under the thermoelectric element 10 and two safety cutoff switches 14 and a cooling fan 13 is provided on the one side of the lower heat exchanging fins 12.

Figure 2:
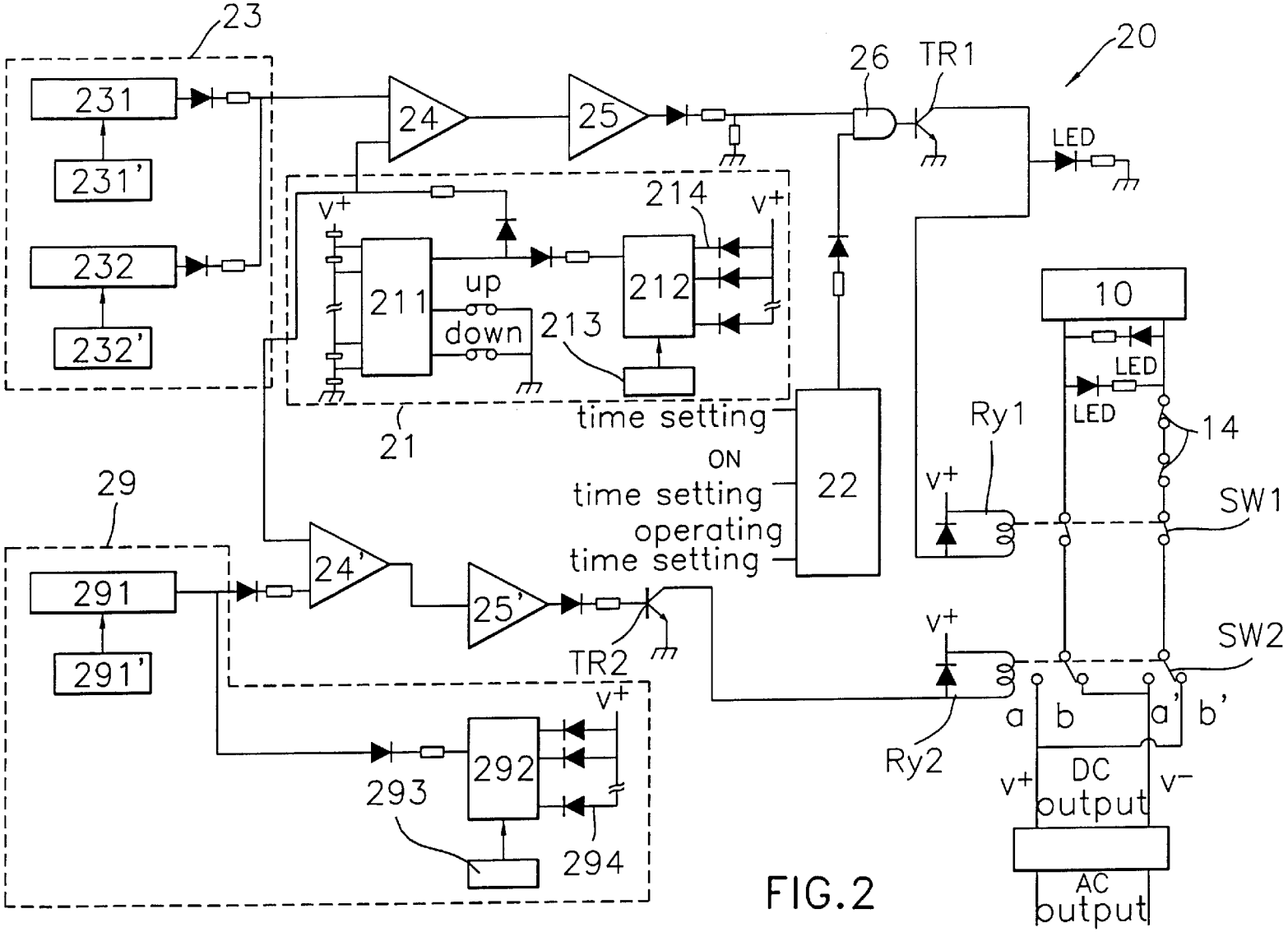
FIG. 2 is a block diagram of a controller for use in the temperature controller of FIG. 1.

The controller 20, as shown in FIG. 2, comprises a bedding temperature setting section 21 for presetting an appropriate temperature of the cooled or warmed bedding equipment 40; an operating time setting section 22 for presetting the operating time; a heat transfer medium temperature sensing section 23 having a supply temperature sensor 231 and a recovery temperature sensor 232; a first comparator 24 for comparing the voltages from the two temperature sensors 231 and 232 with the standard voltage according to the preset temperature of the bedding temperature setting section 21; a first delay timer 25 connected to the output terminal of first comparator 24; an AND gate 26 with the input terminal connected to the operating time setting section 22 and the delay timer 25 and the output terminal connected to first transistor TR1; a relay Ry1 connected to the collector of first transistor TR1; a room temperature sensing section 29 for detecting the room temperature; a second comparator 24' with the input terminal connected to the bedding temperature setting section 21 and the room temperature sensing section 29; a second delay timer 25' with its input terminal connected to the output terminal of the second comparator 24'; a second transistor TR2 connected to the output terminal of the second delay timer 25'; and a relay Ry2 connected to the collector of second transistor TR2.

The temperature sensors 231, 232 and 291 have their own level determiners 231', 232' and 291', respectively.

The bedding temperature setting section 21 comprises a temperature setter 211 for setting an appropriate temperature for the bedding equipment 40; a temperature display 212 for showing the preset temperature with a level indicator 214; and a reference temperature setter 213.

The room temperature sensing section 29 comprises a room temperature sensor 291 for detecting the room temperature; a room temperature display 292 for showing the room temperature with a level indicator 294; and a reference temperature setter 293.

The heat exchanger 30 desirably enclosed in a soundproofing material have tens of heat exchanging fins 11 mounted on the thermoelectric element 10 and comprises a heat exchanging chamber 31 provided with an inlet hole 311 and a discharge hole 312 for the heat transfer medium and a pumping means 32 installed inside the inlet hole 311 of the heat exchanging chamber 31.

If the heat transfer medium to be subject to heat exchange according to the operation of the thermoelectric element 10 is air, the pump means 32 is an air pump to discharge and supply the air to the inside of the bedding equipment 40 through a supplying tube 33 connected to the discharge hole 312 and retrieve the air through a collecting tube 34 connected to the inlet hole 311. The pump means 32 can be a blower instead of the air pump.

In addition, the heat exchanging chamber 31 has a supply temperature sensor 231 therein, while the room temperature sensor 291 may be provided somewhere in communication with the air in the room.

It is desirable that the supplying and collecting tubes 33 and 34 may be, as shown in FIG. 6*c*, provided with an insulating layer 431 and a covering 432.

The bedding equipment 40 is provided with a two-way circulation path divided by a center wall 43 for the heat transfer medium, having an inlet 41 connected to the supplying tube 33 and an outlet 42 connected to the collecting tube 34.

The bedding equipment 40 may be a quilt, a floor mat or a bed mattress.

In the temperature controller for bedding in accordance with first preferred embodiment of the present invention as constituted above, the relay Ry2 is operated to switch the polarity of the power applied to the thermoelectric element 10, while the relay Ry1 turns "on" the thermoelectric element. As the thermoelectric element 10 exposed to the heat exchanger 30 is turned "on" by the operation of the relays Ry1 and Ry2, the heat transfer medium, i.e. the air coming through the inlet hole 311, is heated or cooled and sent to the discharge hole 312 by the operation of the pump means 32, an air pump or a blower.

As above, the air passing through the thermoelectric element 10 and the heat exchanging fins 11 of the heat exchanger 30 is cooled or heated through heat exchanging process and supplied to the inside of the bedding equipment 40 via the supplying tube 33.

The temperature controller is operated as follows:

If the temperature detected by the room temperature sensor 291 is higher than the temperature of the level setter 211, the relay Ry2 operates to connect the switch sw2 to contacts a and a', making the current V− of the power source Vcc flow toward the V+ via the thermoelectric element 10 so as to have the thermoelectric element 10 prepared for absorbing heat. On the contrary, if the room temperature is lower than the temperature of the level setter 211, the relay Ry2 operates to connect the switch sw2 to contacts b and b' so that current V+ of the power source Vcc may flow toward the V− through the thermoelectric element 10, thus having the thermoelectric element 10 prepared for generating heat.

When the temperatures detected by the supply and recovery temperature sensors 231 and 232 are higher or lower than the temperature of the level setter 211, the thermoelectric element 10 is driven with the switch sw1 turned "on" by the operation of the relay Ry1. If the former is equal to the latter, the relay Ry1 turns the switch sw1 "off" to suspend or interrupt the operation of the thermoelectric element 10.

The relays Ry1 and Ry2 are operated according to the result of comparison of the sensed temperatures and the preset appropriate bedding temperature. According to the operations of the delay timers 25 and 25' connected between the comparator 24 and the AND gate 26 or between the comparator 24' and the transistor TR2, output signals from the comparators 24 and 24' are received with a certain time interval and therefore, the thermoelectric element 10 is prevented from being successively switched on and off in a short period of time due to minute temperature gaps or changes.

Cooled or heated by means of heat exchange with the heat exchanging fins 11 of the heat exchanger 30 in the heat exchanging chamber 31, the air is supplied as a heat transfer medium to the inside of the bedding equipment 40 via the supplying tube 33 connected to the discharge hole 312 and the inlet 41 of the circulation path of the heat transfer medium by the operation of the air pump 32, cooling or warming the bedding equipment 40 as passing through the circulation path 441 in the bedding equipment 40 and recovered into the heat exchanging chamber 31 through the inlet hole 311 via the outlet 42 of the circulation path and the collecting tube 34. This process is repeated.

Thus, the bedding equipment 40 is cooled or warmed to a preset appropriate temperature.

FIG. 3*a* illustrates an application of first preferred embodiment of the present invention to a bed. The supplying and collecting tubes 33 and 34, connected to the heat exchanger 30 in order to supply and recover the cool or warm air, are respectively associated to the both ends of the circulation path 441 which is formed in zigzags inside the sponge layer 44 interposed in the bed mattress.

FIG. 6*a* is an enlarged cross-sectional view illustrating a portion of FIG. 3*a*. The tubing forming the circulation path 441 is provided in the sponge layer 45 of the bed mattress and a laminated aluminum layer 451, a waterproof far-infrared ray material layer 452 and a cotton sheet layer 453 may be sequentially provided on the sponge layer 45.

FIG. 3*b* illustrates an application of first preferred embodiment of the present invention to a floor mat. The supplying and collecting tubes 33 and 34, connected to the heat exchanger 30 in order to supply and recover the cool or warm air, are respectively associated to the both ends of the circulation path 441 which is formed in zigzags in the floor mat.

FIG. 4 illustrates another example of the bed mattress in combination with first preferred embodiment of the present invention, in which the circulation path 441 extends in zigzags along sewing lines 45 to pass through the inside of the bed mattress and the inlet 41 formed at the one end of the circulation path 441 is connected to the supplying tube 33, the outlet 42 connected to the collecting tube 34.

In this embodiment, air pathways are formed along the sewing lines 45 in consideration of thermal efficiency and distribution of the cool or warm air without additional circulation tubing and connected to each other, making it possible for the air to be collected therethrough.

FIG. 5 illustrates a perspective view of another type of bed with a bed mattress to which first preferred embodiment of the present invention is applied. FIG. 6*b* is an enlarged cross-sectional view of the bed mattress shown in FIG. 5, in which a circulation path 441 is arranged between the sponge layer 45 and the base board 46 of the mattress of the bed 40 and connected to the supplying tube 33 and the collecting tube 34. A laminated aluminum layer 451, a waterproof far-infrared ray material layer 452 and a cotton sheet layer 453 may be sequentially provided on the spring layer 45.

FIG. 7 illustrates second preferred embodiment of the present invention, in which the blower or air pump 32 sucks the ambient air as a heat transfer medium into the heat exchanging chamber 31 with the heat exchanger 30. The air is cooled or heated through heat exchanging process by the heat exchanging fins 11 and 12 and the thermoelectric element 10 and supplied to the inside of the bedding equipment 40 through the supplying tube 33.

In this embodiment, the heat exchanger 30 is in communication with the outside air through an inlet hole 311' and the bedding equipment 40 is in the form of a floor mat or a quilt designed so that the cool or warm air supplied through the supplying tube 33 may exhale outwardly. Unlike first preferred embodiment, only the supplying tube 33 is provided and connected to the bedding equipment 40.

FIG. 8 illustrates third preferred embodiment of the present invention. As the heat transfer medium used in this embodiment is water, a water pump 32 is provided at the discharge hole 312 in the heat exchanging chamber and a water conduit 51 extends to the inlet hole 311 in order to receive the water through the housing 50.

The water pump 32 is driven to circulate the water through the circulation path 441 in the bedding equipment 40 from the heat exchanging chamber 31 via the supplying tube 33 and receive the water continuously returning from the circulation path into the heat exchanging chamber 31 through the collecting tube 34 and the inlet hole 311.

That means that cold or hot water made by way of heat exchanging process with the thermoelectric element 10 and the heat exchanging fins 11 cools or warms the bedding equipment 40.

The above-described embodiments include a room temperature sensor 291, but the sensor 291 is not essential for the normal room temperature. That's because the bedding system of the present invention can perform its functions according to the preset room temperature which is compared to the temperatures detected by means of the supply and recovery sensors.

Changes or modifications to the present invention are also covered in the scope of protection of the present invention, as long as they cool or warm a heat transfer medium by means of a thermoelectric element which is supplied to the inside of the bedding equipment to maintain it at an appropriate temperature.

As the housing 50 containing the thermoelectric element 10, the controller 20 and the heat exchanger 30 is small in size, it can be arranged on the base board of a bed mattress or a small table to be put by a bed, or at any place in the room.

As described above, the temperature controller for bedding according to the present invention, making heat transfer medium cooled or heated by way of heat exchanging process, presents many advantages in that it can be used through four seasons of a year without any harmful influence to the human body due to the electromagnetic waves generated therefrom and any possibility of a fire.

Furthermore, electric heating wires are not required and the manufacture of the system of the present invention is very simple enough to facilitate the maintenance, repair and other service thereof with reduced costs. The user can easily preset an appropriate bed temperature for himself and the operating time of the system to keep the bedding equipment cool or warm.

INDUSTRIAL APPLICABILITY

As explained above, the present invention provides temperature controllers for bedding which have a fairly simple structure and safety of which is guaranteed, comprising a thermoelectric element selectively serving as a cooler or a heater, a controller to control the operation of the thermoelectric element, a heat exchanger providing heat exchanging process to air water and a bedding equipment which is cooled or warmed by the air or water. The temperature controllers can be widely used in our daily life, ensuring a comfortable and pleasant sleep for us.

What is claimed is:

1. A temperature controller for bedding, comprising:

a thermoelectric element 10 exposed to a heat transfer medium for absorbing or generating heat;

a controller which compares the temperatures detected by a supply temperature sensor and a recovery temperature sensor with an appropriate temperature preset by a bedding temperature setting section and operates the thermoelectric element by outputting an output signal based on the set time of an operating time setting section;

a heat exchanger providing heat exchanging process between the heat transfer medium and the thermoelectric element and supplying the heat transfer medium; and bedding equipment 140 in which the heat transfer medium supplied from the heat exchanger is circulated for returning to the heat exchanger;

wherein the controller comprises a bedding temperature setting section having a temperature setter and a temperature display for setting an appropriate temperature to which the bedding equipment is cooled or heated; a heat transfer medium temperature sensing section having a supply temperature sensor to detect the temperature of the heat transfer medium supplied to the bedding equipment and a recovery temperature sensor to detect the temperature of the returning heat transfer medium; a first comparator for comparing the voltages of the above two temperature sensors with the standard voltage for the preset temperature of the bedding temperature setting section; a first delay timer connected to the output terminal of first comparator; an AND gate with an input terminal connected to first delay timer and the operating time setting section and an output terminal connected to a first transistor; a first relay connected to a collector of the first transistor; a room temperature sensing section having a room temperature sensor; a second comparator with an input terminal connected to the room temperature sensing section and the temperature setter; a second delay timer connected to an output terminal of second comparator; a second transistor connected to an output terminal of a second delay timer; and a second relay connected to a collector of second transistor.

2. A temperature controller as claimed in claim 1, wherein the controller 20 comprises:

a bedding temperature setting section 21 having a temperature setter 211 and a temperature display 212 for setting an appropriate temperature to which the bedding equipment 40 shall be cooled or heated;

a heat transfer medium temperature sensing section 23 having a supply temperature sensor 231 to detect the temperature of the heat transfer medium supplied to the bedding equipment 40 and a recovery temperature sensor 232 to detect the temperature of the returning heat transfer medium;

a first comparator 24 for comparing the voltages of the above two temperature sensors 231, 232 with the standard voltage for the preset temperature of the bedding temperature setting section 21;

a first delay timer 25 connected to the output terminal of first comparator 24;

an AND gate 26 with the input terminal connected to first delay timer 25 and the operating time setting section 22 and the output terminal connected to first transistor TR1;

a first relay Ry1 connected to the collector of first transistor TR1;

a room temperature sensing section 29 having a room temperature sensor 291;

a second comparator 24' with the input terminal connected to the room temperature sensing section 29 and the temperature setter 211;

a second delay timer 25' connected to the output terminal of second comparator 24';

a second transistor TR2 connected to the output terminal of second delay timer 25'; and a second relay Ry2 connected to the collector of second transistor TR2.

3. A temperature controller as claimed in claim 1, wherein the heat exchanger comprises:

a heat exchanging chamber having an inlet hole and a discharge hole for the heat transfer medium;

a pump means provided in the heat exchanging chamber for supplying the heat transfer medium; and heat exchanging fins associated with the thermoelectric element 10.

4. A temperature controller as claimed in claim 3, wherein the heat transfer medium is air and the pump means is an air pump.

5. A temperature controller as claimed in claim 3, wherein the heat transfer medium is water and the pump means 32 is a water pump.

6. A temperature controller as claimed in claim 1, wherein the bedding equipment 40 comprises a bed mattress having a sponge layer 45 with a laminated aluminum layer, a far-referred ray material layer and a cotton sheet cover sequentially provided thereon, the inside of the sponge layer having a circulation tubing 44 for the heat transfer medium passing therethrough, the circulation path 441 being formed with the tubing having both ends respectively connected to supplying and collecting tubes 33, 34 for the heat transfer medium.

7. A temperature controller as claimed in claim 1, wherein the bedding equipment comprises a bed mattress with a circulation path for the heat transfer medium being formed therein along sewing lines.

8. A temperature controller as claimed in claim 1, wherein the bedding equipment 40 comprises a bed mattress 402 having a two-way circulation path 441 divided by a center wall 43 for the heat transfer medium.

9. A temperature controller for bedding, comprising:

a thermoelectric element 10 for absorbing or generating heat which is exposed to air functioning as a heat transfer medium;

a controller for comparing temperatures detected by a room temperature sensor 291, a supply temperature sensor 231 for the heat transfer medium and a bedding temperature sensor 232' with an appropriate temperature preset by a bedding temperature setting section 21 and operating the thermoelectric element 10 by outputting an output signal based on the set time of an operating time setting section 22;

a heat exchanger 30 for sucking the external air as the heat transfer medium and causing heat exchanging process between the air and the thermoelectric element 10 for supplying the air outwardly; and a bedding equipment 40 provided with pathways for the air supplied from the heat exchanger 30, the air being exhaled outwardly therefrom.

10. A temperature controller for bedding, comprising:

a thermoelectric element exposed to a heat transfer medium for absorbing or generating heat;

a controller which compares the temperatures detected by a supply temperature sensor and a recovery temperature sensor with an appropriate temperature preset by a bedding temperature setting section and operates the thermoelectric element by outputting an output signal;

a heat exchanger providing heat exchanging process between the heat transfer medium and the thermoelectric element and supplying the heat transfer medium; and a bed mattress having a circulation path in which the heat transfer medium supplied from the heat exchanger is circulated for returning to the heat exchanger.

11. A temperature controller as claimed in claim 10, wherein the circulation path for the heat transfer medium is formed along sewing lines.

12. A temperature controller as claimed in claim 11, wherein the controller operates the thermoelectric element by outputting the output signal based on the set time of an operating time setting section.

13. A temperature controller as claimed in claim 10, wherein the heat transfer medium is air.

* * * * *